US009874419B1

(12) United States Patent
Beck

(10) Patent No.: US 9,874,419 B1
(45) Date of Patent: Jan. 23, 2018

(54) INTEGRATED RIFLE BUTT MONOPOD FOR PRECISION MARKSMANSHIP

(71) Applicant: BilletMade, LLC, Boca Raton, FL (US)

(72) Inventor: Eric Beck, Boca Raton, FL (US)

(73) Assignee: BILLETMADE, LLC, Boca Raton, FL (US)

( * ) Notice: Subject to any disclaimer, the term of this patent is extended or adjusted under 35 U.S.C. 154(b) by 0 days.

(21) Appl. No.: 15/206,520

(22) Filed: Jul. 11, 2016

(51) Int. Cl.
*F41A 23/06* (2006.01)
*F41C 23/20* (2006.01)

(52) U.S. Cl.
CPC ..... *F41A 23/06* (2013.01); *F41C 23/20* (2013.01)

(58) Field of Classification Search
CPC ..... F41A 23/06; F41A 23/04; F41C 33/003; F41C 23/20; F41C 23/14; F16M 13/00; F16M 11/26
USPC ..... 42/94; 248/457; 89/40.01
See application file for complete search history.

(56) References Cited

U.S. PATENT DOCUMENTS 4,345,398 A * 8/1982 Pickett ..... F41A 23/06 42/94
4,393,614 A * 7/1983 Pickett ..... F41A 23/06 42/94
4,676,021 A * 6/1987 Groba ..... F16B 2/246 42/94
5,345,706 A * 9/1994 Brown ..... F41A 23/06 42/94
7,100,318 B1 * 9/2006 Beltz ..... F41A 23/06 248/274.1
8,161,956 B2 * 4/2012 Bednar ..... F41A 23/06 124/25
2002/0040544 A1 * 4/2002 Muhlestein ..... F41A 23/06 42/94
2013/0174463 A1 * 7/2013 Hinds ..... F41A 23/04 42/94
2014/0259849 A1 * 9/2014 Jakele ..... F41C 23/20 42/74
2017/0074618 A1 * 3/2017 Wichner ..... F41A 17/12
2017/0089659 A1 * 3/2017 Almond ..... F41C 23/16

* cited by examiner

*Primary Examiner* — Samir Abdosh
(74) *Attorney, Agent, or Firm* — Steven M. Greenberg, Esq.; CRGO Law

(57) ABSTRACT

Embodiments of the invention provide am integrated rifle butt mono-pod for precision marksmanship. In an embodiment of the invention, a projectile weapon accessory is adapted for precision marksmanship. The accessory includes a mono-pod assembly secured to a rifle at a distal end of a stock of the rifle with at least one screw passing from a butt cap of the stock through the assembly into the stock. The assembly itself includes a body portion having an exterior profile generally consistent with an exterior profile of the stock, and a leveling bolt fixed to a bolt fastener disposed at a bottom of the body portion.

14 Claims, 4 Drawing Sheets

INTEGRATED RIFLE BUTT MONOPOD FOR PRECISION MARKSMANSHIP

BACKGROUND OF THE INVENTION

Field of the Invention

The present invention relates to stabilizing rifle accessories for precision marksmanship and more particularly to a monopod rifle attachment.

Description of the Related Art

A marksman or sharpshooter is a person who is skilled in precision shooting at long range targets using a projectile weapon such as a rifle, and most commonly in connection with a designated marksman rifle or a special application rifle. Essential to precision marksmanship is the integration of human performance with a projectile weapon. Human performance in precision marksmanship depends upon proper body physiology including a limitation of movement of the human body—especially in consequence of breathing. Thus, stability of the shooter and projectile weapon are of paramount importance. To that end, different weapon accessories have been developed and are frequently utilized so as to promote weapon stability.

Traditionally, weapon accessories intended to promote rifle stability including shooting sticks, mono-pods, bi-pods and tri-pods. Shooting sticks are portable weapon mounts used by field shooters, similar to a monopod, bipod or tripod, with one, two or three legs. Shooting sticks are commonly used on rifles to provide a forward rest and reduce motion. Shooting sticks generally mount at a fore stock portion of rifle and permit the operator to rest the weapon on the ground, a low wall, or other object, reducing operator fatigue and permitting increased accuracy. Shooting sticks can be of fixed or adjustable length. Bi-pods and tri-pods similarly reduce the motion of the rifle, but are principally mounted at a barrel portion of the rifle and are intended for use when the operator shoots from a prone position. A mono-pod, in turn, stabilizes the rifle at a particularly vulnerable portion of the rifle—the stock, where the body of the operator meets the weapon.

The typical mono-pod design mounts at a bottom portion of the stock and provides for a variable adjusting single leg contacting the ground. As well, a non-slip material often coats the portion of the mono-pod contacting the ground so as to add a further degree of stability of the stock of the rifle. In its most simple form, the mono-pod is a threaded bolt that secures to complimentary threads at a bottom portion of the stock. More complicated mono-pod assemblies attach to the butt of the stock by way of a butt cap with the cap forming an intermediary adapter for the mono-pod so as to allow the retrofitting of an off-the-shelf model weapon. For those mono-pods that mount at the butt of the stock, oftentimes the cap is secured to the butt with one or more bolts driven from the cap into horizontal threads formed longitudinally through the butt.

Conventional mono-pods, while enhancing the accuracy of a rifle shot, are not without drawbacks. First, adjusting a length of the mono-pod can be challenging without the use of two hands—particularly where the mono-pod extends by simply rotating the mono-pod counter-clockwise so as to "unscrew" the bolt affixing the monopod to the rifle stock or to the cap affixed to the butt of the rifle stock. Other enhanced adjustment mechanisms include an articulating adjustment rod that, when disengaged, permits the extension or contraction of the mono-pod and when engaged, fixes the length of the mono-pod. However, as in the case of other adjustment mechanisms, in this instance, two hands are required for operation.

Of particular concern, the mounting of a mono-pod to a rifle stock results in some play between the mono-pod and the rifle during use. More particularly, the interface between the mono-pod and the rifle is of limited extent relative to the size of the rifle resulting in excessive torque forces experienced at the mounting point of the mono-pod to the rifle stock. Consequently, the rifle is able to shift its position during a shot despite the presence of the mono-pod and, as a result, accuracy of a given shot is compromised.

BRIEF SUMMARY OF THE INVENTION

Embodiments of the present invention address deficiencies of the art in respect to rifle mono-pods and provide a novel and non-obvious integrated rifle butt mono-pod for precision marksmanship. In an embodiment of the invention, a projectile weapon accessory is adapted for precision marksmanship. The accessory includes a mono-pod assembly secured to a rifle at a distal end of a stock of the rifle with at least one screw passing from a butt cap of the stock through the assembly into the stock. The assembly itself includes a body portion having an exterior profile generally consistent with an exterior profile of the stock, and a leveling bolt fixed to a bolt fastener disposed at a bottom of the body portion.

In one aspect of the embodiment, the leveling bolt is threaded, but the bolt fastener unthreaded. As such, the bolt fastener further includes a spring loaded plunger with perpendicular channel releasably perpendicularly engaging by a wall of the channel the threaded leveling bolt responsive to activating the plunger. Alternatively, in another aspect of the embodiment, the leveling bolt is threaded and the bolt fastener is complementarily threaded such that the leveling bolt securely engages the bolt fastener securing the leveling bolt to the body portion. In yet another aspect of the embodiment, the leveling bolt is threaded and includes a locking nut secured about the leveling bolt between the bottom of the body portion and a distal end of the leveling bolt opposite the bolt fastener. In this way, the minimum extension of the leveling bolt is defined by the positioning of the locking nut from the distal end of the leveling bolt.

Notably, in another aspect of the embodiment, the body portion defines a hollow cavity by a cavity wall formed by a perimeter of the body portion. The bolt fastener in turn is disposed within a bottom portion of the cavity wall, and the leveling bolt extends past the bolt fastener from outside of the body portion into the hollow cavity. Optionally, the body portion includes exactly one solid face at a plane defined by at least a portion of one of two perimeter edges of the body portion. The solid face includes at least one depression adapted to receive a counterbored threaded bolt secured into a threaded fastener embedded into a butt of the stock. As well, as another option, a surface of the cavity wall opposite the plane includes a threaded fastener that receives a screw securing a butt cap of a butt of the stock to the surface of the cavity wall opposite the plane. Finally, as yet another option, an additional screw longer than the screw securing the butt cap to the threaded fastener of the surface of the cavity wall opposite the plane secures the butt cap directly to the butt of the stock through the cavity.

Additional aspects of the invention will be set forth in part in the description which follows, and in part will be obvious from the description, or may be learned by practice of the invention. The aspects of the invention will be realized and attained by means of the elements and combinations particularly pointed out in the appended claims. It is to be understood that both the foregoing general description and the following detailed description are exemplary and explanatory only and are not restrictive of the invention, as claimed.

BRIEF DESCRIPTION OF THE SEVERAL VIEWS OF THE DRAWINGS

The accompanying drawings, which are incorporated in and constitute part of this specification, illustrate embodiments of the invention and together with the description, serve to explain the principles of the invention. The embodiments illustrated herein are presently preferred, it being understood, however, that the invention is not limited to the precise arrangements and instrumentalities shown, wherein.

DETAILED DESCRIPTION OF THE INVENTION

Embodiments of the invention provide for a projectile weapon accessory adapted for precision marksmanship and a rifle integrated therewith. In accordance with an embodiment of the invention, a mono-pod assembly is affixed to a projectile weapon such as a rifle with a stock at one end, a barrel at an opposite end and a fore stock disposed between the stock and the barrel. Specifically, the mono-pod assembly is secured to the weapon at a distal end of the stock with at least one screw passing from a butt cap of the stock through the assembly into the stock. The assembly itself has a body portion with an exterior profile generally consistent with an exterior profile of the stock. The assembly also includes a leveling bolt fixed to a bolt fastener disposed at a bottom of the body portion. Optionally, the leveling bolt is threaded and the bolt fastener unthreaded such that a spring loaded plunger with perpendicular channel included as part of the body portion releasably perpendicularly engages by a wall of the channel the threaded leveling bolt responsive to activating the plunger. In this way, while the assembly is securely affixed to the stock with a minimum of play, the leveling bolt of the assembly can be rapidly extended or retracted with only the depression of the plunger and without requiring the use of both hands of the operator.

Figure 1:
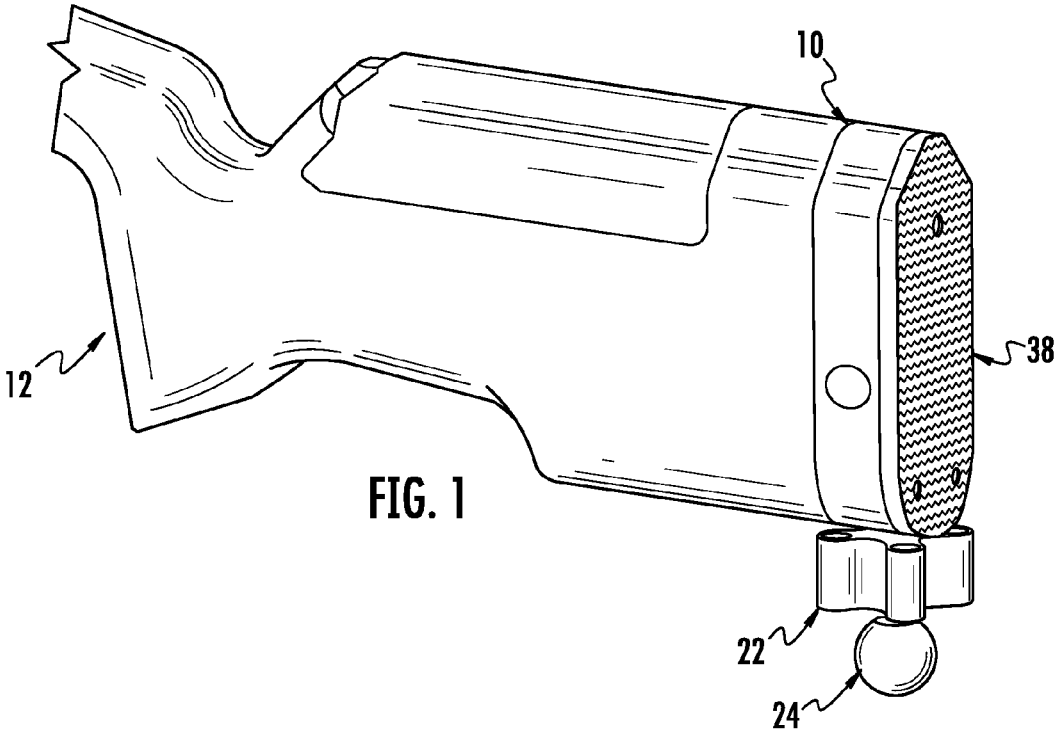
FIG. 1 is a perspective view of a stock of a projectile weapon adapted for precision marksmanship with a mono-pod assembly in a retracted position.
Figure 2:
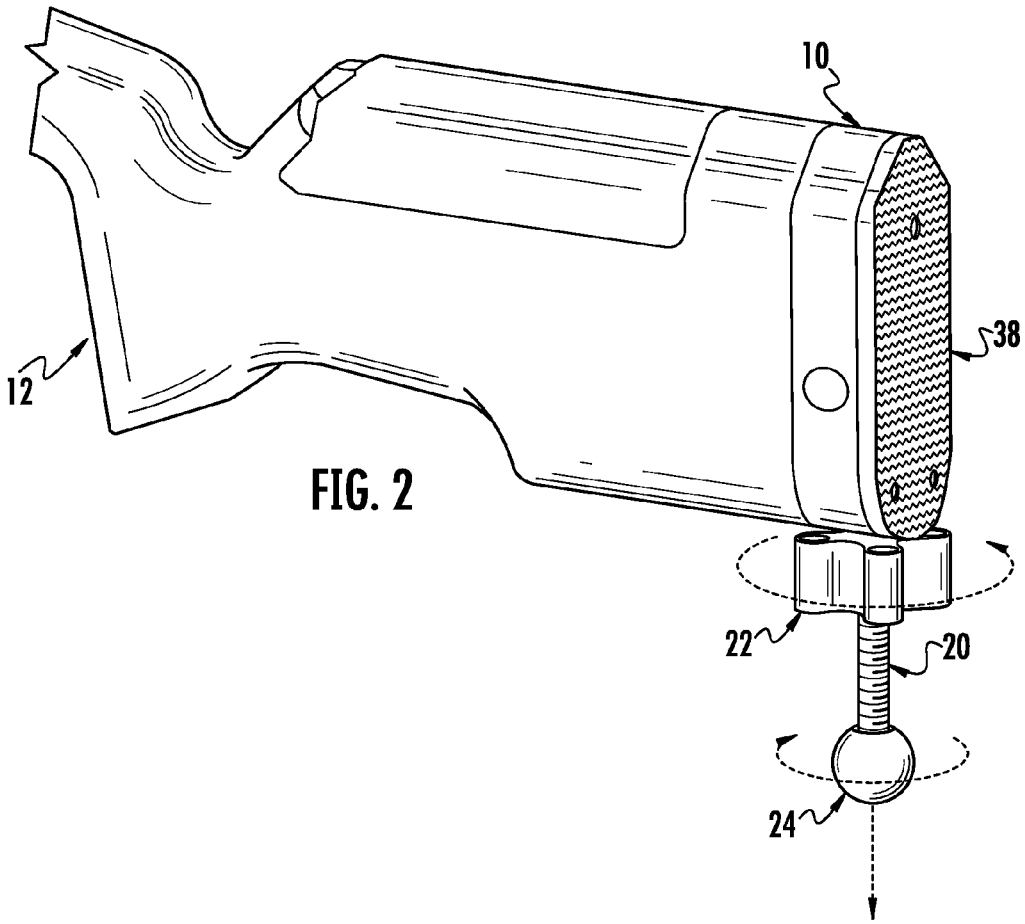
FIG. 2 is a perspective view of a stock of a projectile weapon adapted for precision marksmanship with a mono-pod assembly in an extended position.
Figure 5:
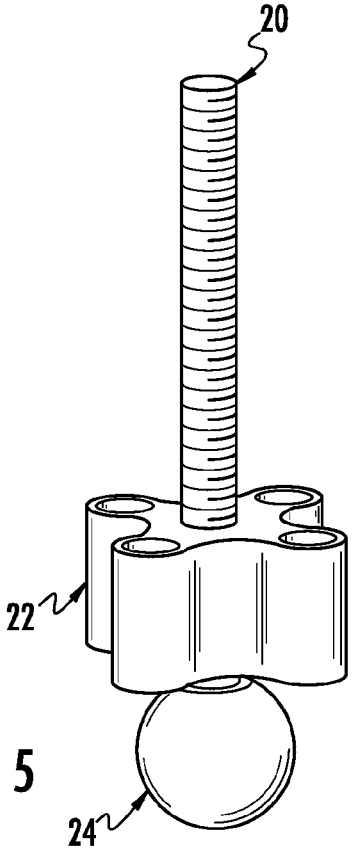
FIG. 5 is a perspective view of the leveling bolt of the mono-pod assembly of FIGS. 1 and 2.

In further illustration, FIGS. 1 and 2, taken together, are a perspective view of a stock of a projectile weapon adapted for precision marksmanship with a mono-pod assembly in both a retracted position and also an extended position. As shown in FIG. 1, mono-pod assembly includes a body portion 10 affixed to a stock 12 of a projectile weapon such as a rifle and secured to the stock 12 by way of a butt cap 38. Referring to FIG. 2, a threaded leveling bolt 20 is included as part of the mono-pod assembly and inserted into a bolt fastener (not shown) disposed within a bottom of the body portion 10 of the mono-pod assembly. Optionally, as shown in connection with FIG. 5, a foot 24 is affixed to a distal end of the leveling bolt 20 opposite the bottom of the body portion 10 of the mono-pod assembly. The foot 24 may be a metallic cylinder with a non-metallic cap (not shown), or a non-metallic sphere as shown.

Of note, the leveling bolt 20 may be retracted into the bolt fastener as shown in FIG. 1, or extended from the bolt fastener as shown in FIG. 2. Furthermore, as illustrated in connection with FIG. 5, a locking nut 22 may be secured about the leveling bolt 20 between a bottom of the body portion 10 of the mono-pod assembly and a distal end of the leveling bolt 20 opposite the bolt fastener. The locking nut 22 limits according to its placement about the length of the leveling bolt 20 an extent to which the leveling bolt 20 may be retracted into the bolt fastener and further limits both vertical and latitudinal movement of the leveling bolt 20 when secured against the bottom of the body portion 10 of the mono-pod assembly. Optionally, the locking nut 22 has formed thereon a spacer (not shown) that prevents the locking nut 22 from directly abutting a bottom surface of the body portion 10.

Figure 3:
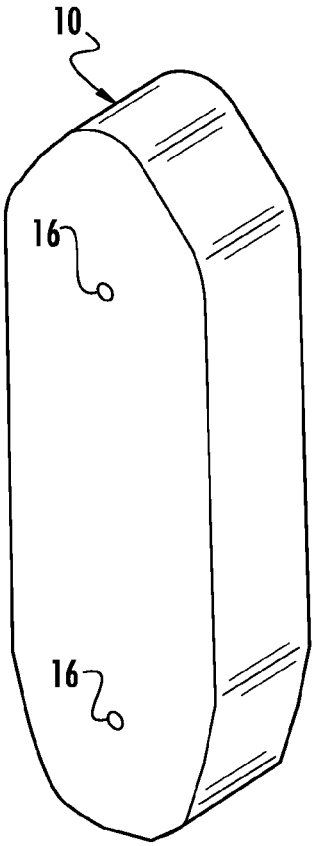
FIG. 3 is a perspective view of a solid face of a body portion of the mono-pod assembly of FIGS. 1 and 2.
Figure 4:
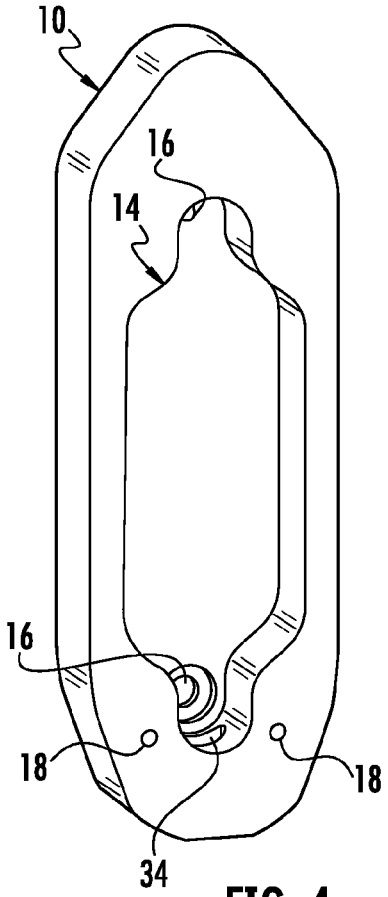
FIG. 4 is a perspective view of a hollow cavity of the body portion of the mono-pod assembly of FIG. 3.

In further illustration, FIGS. 3 and 4, taken together, provide a perspective view of the body portion of the mono-pod assembly of FIGS. 1 and 2. As shown in FIG. 3, in one aspect of the embodiment, the body portion 10 of the mono-pod assembly includes exactly one solid face at a plane defined by at least a portion of one of two perimeter edges of the body portion 10. As will be apparent from FIG. 4, the solid face includes at least one depression 16 adapted to receive a counterbored threaded bolt secured into a threaded fastener (not shown) embedded into a butt of the stock of a weapon. As well, referring to FIG. 4, the body portion 10 defines a hollow cavity 14 by a cavity wall formed by a perimeter of the body portion 10. Additionally, the bolt fastener 34 is shown disposed within a bottom portion of the cavity wall so that the leveling bolt (not shown), when inserted into the body portion 10 extends past the bolt fastener 34 from outside of the body portion 10 into the hollow cavity 14.

Figure 6:
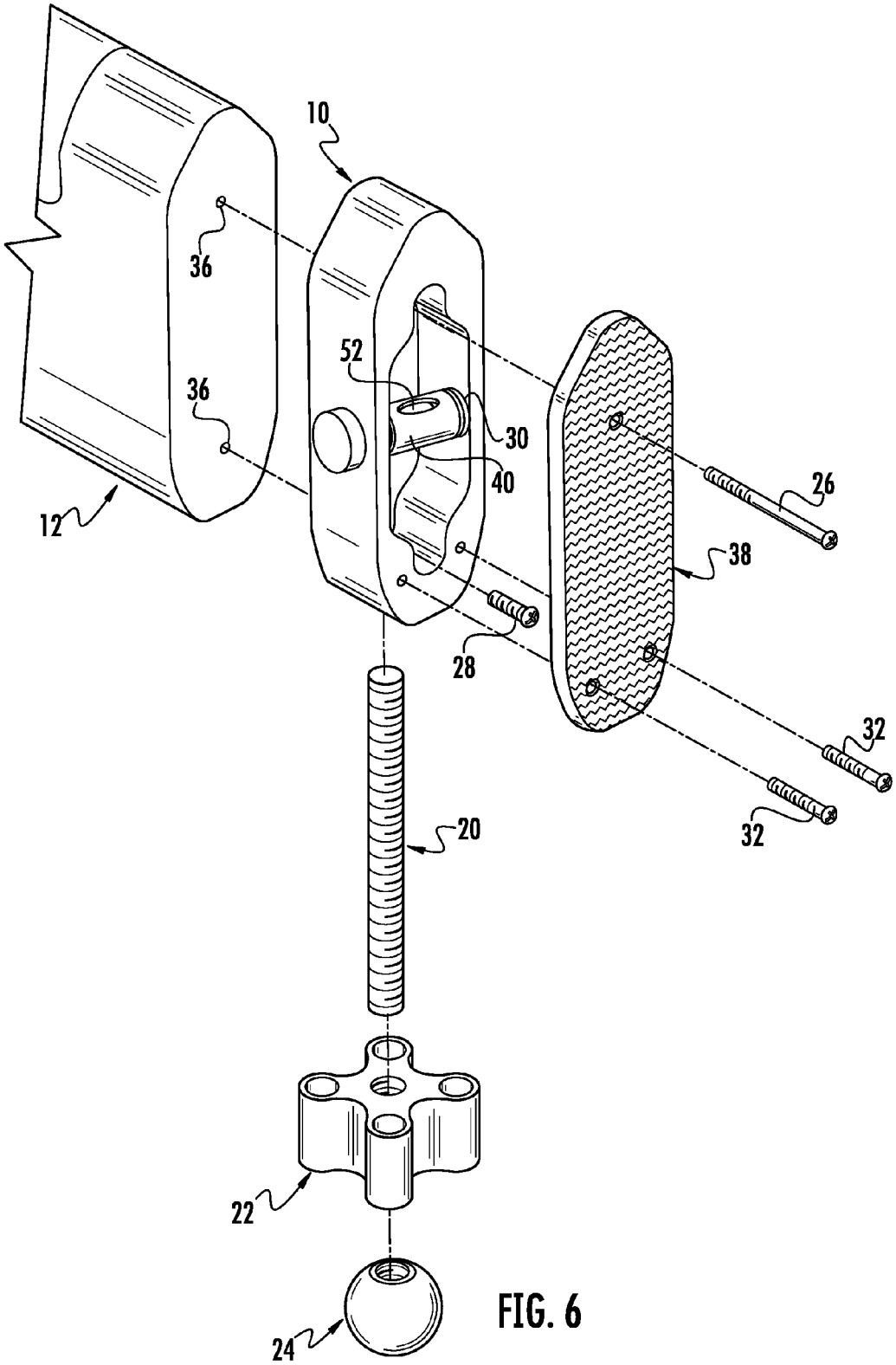
FIG. 6 is a perspective view of a disassembly of the stock of the projectile weapon of FIGS. 1 and 2; and, FIG. 7 is a side cut-away view of the mono-pod assembly as secured to the stock of the projectile weapon of FIG. 1.

In yet further illustration, FIG. 6 is a perspective view of a disassembly of the stock of the projectile weapon of FIGS. 1 and 2. In reference to FIG. 6, the body portion 10 of the mono-pod assembly is positioned between the stock 12 and butt cap 38 and partially secured to the stock 12 by way of the fastening of counterbored threaded bolt 28 secured into a threaded fastener 36 embedded into the butt of the stock 12. The butt cap 38 is then secured to the body portion 10 of the mono-pod assembly with one or more screws 32 fastened to threaded fasteners defined within the cavity wall of the body portion 10 of the mono-pod assembly. Finally, an additional screw 26 longer than the screws 32 securing the butt cap 38 to the threaded fasteners of the surface of the cavity wall of the body portion 10 secures the butt cap 38 directly to a threaded fastener 36 of the butt of the stock 12 through the cavity of the body portion 10. The result is a complete integration of the body portion 10 to the stock 12 of the projectile weapon.

Importantly, the leveling bolt 20 with optional non-metallic sphere 24 is secured to the body portion 10 and adjusted according to the placement of the locking nut 22 at a position along the length of the leveling bolt 20. The leveling bolt 20 may either be secured to the body portion 10 by way of complimentary threads in the bolt fastener (shown in FIGS. 4 and 7) of the body portion 10, or by the spring loaded engagement of a an interior wall of a channel of a plunger 40 with the threads of the bolt fastener 20 as shown herein. Specifically, as shown in FIG. 6, a plunger 40 with a perpendicular channel 52 defined therethrough is disposed within the cavity wall of the body portion 10 with an activatable portion of the plunger 40 positioned at an exterior position of the body portion 10.

The plunger 40 includes a spring 30 at a distal end so as to bias a wall of the channel 52 against the leveling bolt 20 when the leveling bolt 20 is present in the channel 52 within the hollow cavity 14. When contacting the threads of the leveling bolt 20, the wall of the channel 52 inhibits leveling bolt 20 from longitudinal movement into and out from the hollow cavity 14 of the body portion 10. Activation of the activatable portion of the plunger 40 pushes the wall of the channel 52 away from the threads of the leveling bolt 20 resulting in the uninhibited longitudinal movement of the leveling bolt 20 into and out of the hollow cavity 14 of the body portion 10 thereby permitting rapid adjustment of the positioning of the leveling bolt 20.

Figure 7:
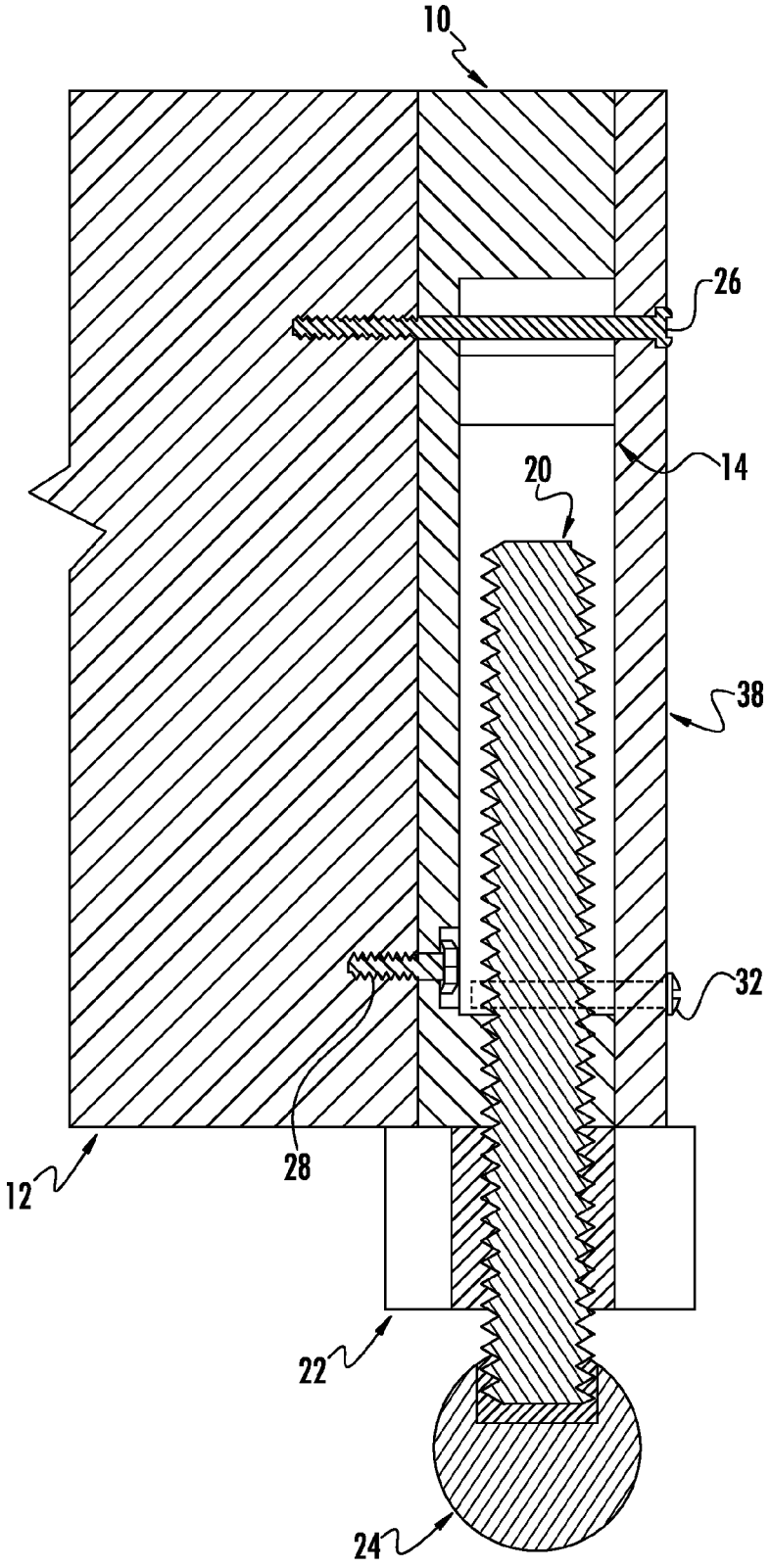

A plunger 40, however, is not required to inhibit the movement of the leveling bolt 20 within the hollow cavity 14. In alternative aspect of the embodiment, the bolt fastener 34 may secure the leveling bolt 20 by way of complimentary threaded fastening. In even yet further illustration of the structure and operation of the securing the leveling bolt 20 to the body portion 10 of the mono-pod assembly, FIG. 7 is a side cut-away view of the mono-pod assembly as secured to the stock of the projectile weapon of FIG. 1. Referring to FIG. 7, the leveling bolt 20 with non-metallic sphere 24 is shown in a retracted position through the bolt fastener 34 with complimentary threads and within the cavity 14 of the body portion 10 of the mono-pod assembly and additionally secured with limited retraction by locking nut 22. The body portion 10 itself is secured to the stock 12 by counterbored threaded bolt 28 and the compression force of the butt cap 38 against the body portion 10 resulting from the fixation of the butt cap 38 to the stock 12 by the additional screw 26. The butt cap 38 additionally is secured to the body portion 10 with one or more screws 32.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

Having thus described the invention of the present application in detail and by reference to embodiments thereof, it will be apparent that modifications and variations are possible without departing from the scope of the invention defined in the appended claims as follows:

I claim:

1. A projectile weapon adapted for precision marksmanship, the weapon comprising:

a rifle comprising a stock at one end of the rifle, a barrel at an opposite end of the rifle and a fore stock disposed between the stock and the barrel; and a mono-pod assembly secured to the rifle at a distal end of the stock with at least one screw passing from a butt cap of the stock through the assembly into the stock;

the assembly comprising (1) a body portion having an exterior profile generally consistent with an exterior profile of the stock and defining a hollow cavity by a cavity wall formed by a perimeter of the body portion, the body portion comprising exactly one solid face at a plane defined by at least a portion of one of two perimeter edges of the body portion, the solid face comprising at least one depression adapted to receive a counterbored threaded bolt secured into a threaded fastener embedded into a butt of the stock, and (2) a leveling bolt fixed to a bolt fastener disposed at a bottom of the body portion, wherein the bolt fastener is disposed within a bottom portion of the cavity wall, and wherein the leveling bolt extends past the bolt fastener from outside of the body portion into the hollow cavity.

2. The weapon of claim 1, wherein the leveling bolt is threaded, the bolt fastener unthreaded, and wherein the bolt fastener further comprises a spring loaded plunger with a perpendicular channel defined therethrough, a wall of the channel releasably engaging the threaded leveling bolt responsive to activating the plunger.

3. The weapon of claim 1, wherein the leveling bolt is threaded and wherein the bolt fastener is complementarily threaded.

4. The weapon of claim 1, wherein the leveling bolt is threaded and includes a locking nut secured about the leveling bolt between the bottom of the body portion and a distal end of the leveling bolt opposite the bolt fastener.

5. The weapon of claim 1, wherein a surface of the cavity wall opposite the plane comprises a threaded fastener, the weapon further comprising a butt cap and a screw, the screw securing the butt cap to the threaded fastener of the surface of the cavity wall opposite the plane.

6. The weapon of claim 5, further comprising an additional screw longer than the screw securing the butt cap to the threaded fastener of the surface of the cavity wall opposite the plane, the additional screw securing the butt cap directly to the butt of the stock through the cavity.

7. The weapon of claim 1, wherein a foot is affixed to a distal end of the leveling bolt opposite the bottom of the body portion of the mono-pod assembly.

8. A projectile weapon accessory adapted for precision marksmanship, the accessory comprising:

a mono-pod assembly secured to a rifle at a distal end of a stock of the rifle with at least one screw passing from a butt cap of the stock through the assembly into the stock;

the assembly comprising (1) a body portion having an exterior profile generally consistent with an exterior profile of the stock and defining a hollow cavity by a cavity wall formed by a perimeter of the body portion, the body portion comprising exactly one solid face at a plane defined by at least a portion of one of two perimeter edges of the body portion, the solid face comprising at least one depression adapted to receive a counterbored threaded bolt secured into a threaded fastener embedded into a butt of the stock, and (2) a leveling bolt fixed to a bolt fastener disposed at a bottom of the body portion of the mono-pod assembly, wherein the bolt fastener is disposed within a bottom portion of the cavity wall, and wherein the leveling bolt extends past the bolt fastener from outside of the body portion into the hollow cavity.

9. The accessory of claim 8, wherein the leveling bolt is threaded, the bolt fastener unthreaded, and wherein the bolt fastener further comprises a spring loaded plunger with a perpendicular channel defined therethrough, a wall of the channel releasably engaging the threaded leveling bolt responsive to activating the plunger.

10. The accessory of claim 8, wherein the leveling bolt is threaded and wherein the bolt fastener is complementarily threaded.

11. The accessory of claim 8, wherein the leveling bolt is threaded and includes a locking nut secured about the leveling bolt between the bottom of the body portion and a distal end of the leveling bolt opposite the bolt fastener.

12. The accessory of claim 8, wherein a surface of the cavity wall opposite the plane comprises a threaded fastener, the weapon further comprising a butt cap and a screw, the threaded fastener receiving a screw securing a butt cap of a butt of the stock to the surface of the cavity wall opposite the plane.

13. The accessory of claim 12, further comprising an additional screw longer than the screw securing the butt cap to the threaded fastener of the surface of the cavity wall opposite the plane, the additional screw securing the butt cap directly to the butt of the stock through the cavity.

14. The accessory of claim 8, wherein a foot is affixed to a distal end of the leveling bolt opposite the bottom of the body portion of the mono-pod assembly.

* * * * *